US005099898A

United States Patent [19]

Miller

[11] Patent Number: 5,099,898

[45] Date of Patent: Mar. 31, 1992

[54] COMBINATION GOLF CLUB COVER AND BEVERAGE INSULATOR

[76] Inventor: David T. Miller, 3049 SE. Doubleton Dr., Stuart, Fla. 34997

[21] Appl. No.: 608,205

[22] Filed: Nov. 2, 1990

[51] Int. Cl.[5] ..... A61J 57/00; B65D 65/02

[52] U.S. Cl. ..... 150/160; 150/154; 150/901; 224/274; 220/903

[58] Field of Search ..... 150/154, 159, 160, 901; 206/315.2-315.8; 224/274; 220/85 H, 903

[56] References Cited

U.S. PATENT DOCUMENTS

| | | | |
|---|---|---|---|
| 625,862 | 5/1899 | Wateridge | 217/3 BC |
| 2,035,529 | 3/1936 | Bucklin | 150/160 |
| 2,521,573 | 9/1950 | Filler et al. | 206/315.5 X |
| 2,526,985 | 10/1950 | Whitehead | 150/160 |
| 2,532,195 | 11/1950 | Rosenow et al. | 150/160 |
| 2,705,039 | 3/1955 | Halter | 150/160 |
| 3,128,812 | 4/1964 | Scheurer | 206/315.4 |
| 3,303,865 | 2/1967 | Ouimet | 150/160 |
| 3,478,799 | 11/1969 | Hoyt, Jr. | 150/160 |
| 3,492,746 | 2/1970 | Hauck | 150/160 X |
| 3,638,284 | 2/1972 | Baker | 150/160 X |
| 3,727,659 | 4/1973 | Shuford | 206/315.4 X |
| 3,965,955 | 6/1976 | Price | 150/160 |
| 3,985,171 | 10/1976 | Summers et al. | 150/159 |
| 4,164,969 | 8/1979 | Dien | 150/160 X |
| 4,282,279 | 8/1981 | Strickland | 150/901 X |
| 4,293,015 | 10/1981 | McGough | 150/901 X |
| 4,296,787 | 10/1981 | Barton | 150/160 |
| 4,418,733 | 12/1983 | Kallman | 383/86 X |
| 4,514,995 | 7/1985 | Curtis et al. | 150/154 X |
| 4,540,611 | 9/1985 | Henderson | 150/901 X |
| 4,625,862 | 12/1986 | Clayton | 206/315.3 |
| 4,667,716 | 5/1987 | Solheim et al. | 150/160 |

FOREIGN PATENT DOCUMENTS

| | | | |
|---|---|---|---|
| 510020 | 7/1939 | United Kingdom | 150/160 |
| 974912 | 11/1964 | United Kingdom | 150/160 |

*Primary Examiner*—Sue A. Weaver

*Attorney, Agent, or Firm*—Malin, Haley, McHale, DiMaggio & Crosby

[57] ABSTRACT

What is provided is a combination golf club cover and beverage insulator which comprises a unitary device. The outer cover has two sections, a first section which receives the golf club head, and a second section which houses the insulating device which receives the beverage. The insulator is a cylindrical sleeve open at both ends which allows the club to pass through the insulator to the furthermost portion of the golf club cover. Once the cover is removed, a beverage can conveniently be placed within the insulator.

15 Claims, 2 Drawing Sheets

FIG, 1
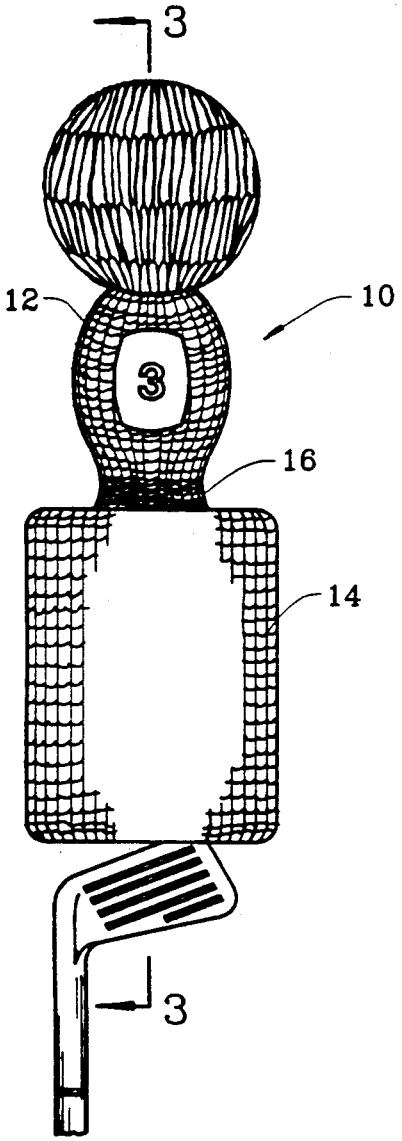
FIG. 2
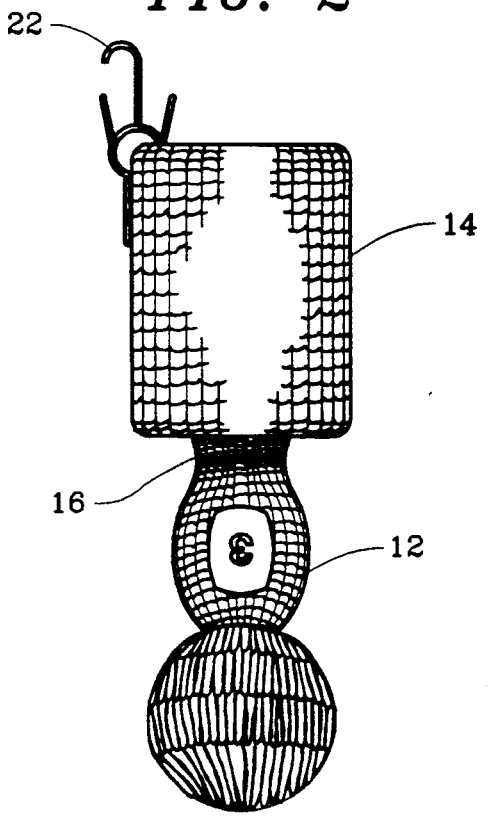
FIG. 3
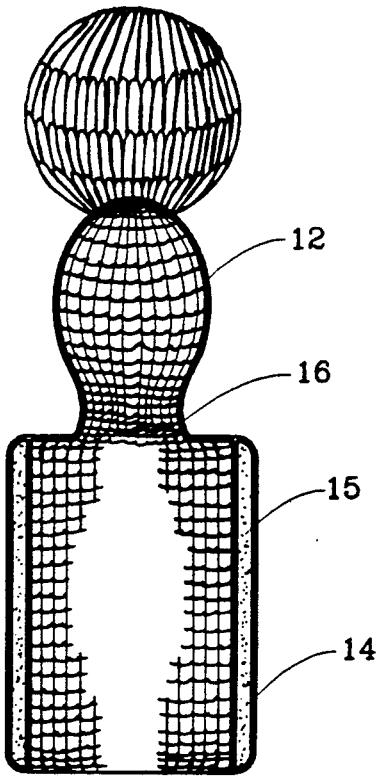

COMBINATION GOLF CLUB COVER AND BEVERAGE INSULATOR

BACKGROUND OF THE INVENTION

1. Field of the Invention

The subject matter of the invention relates to golf club covers and more particularly to a combination golf club cover which incorporates a thermal beverage insulator as an integral part of the cover.

2. Description of Related Art

Over the years golfers have developed a number of accessory products for use with golf clubs and golf bags. These include a variety of golf club covers, cleaning equipment, decorative items, and novelty items. For example, U.S. Pat. No. 3,478,799 discloses a basic golf club cover; U.S. Pat. No. 3,128,812 discloses a type of golf club cover which is readily detachable from a golf bag; U.S. Pat. No. 4,625,862 discloses a decorative golf club cover with tassels; U.S. Pat. No. 3,638,284 discloses a cover and temporary restraining device; and U.S. Pat. No. 3,965,955 discloses a waterproof golf club cover.

Although many of the above referenced patents relate to some form of a golf club cover, none of these inventions teach or suggest a combination golf club cover which includes a beverage insulator as a unitary device.

No matter what their level of skill, most golfers enjoy refreshments on the course during a round of golf. These refreshments include soft drinks such as Coke, Pepsi, Root Beer and the like, as well as beer. These drinks conventionally are available in twelve (12) or sixteen (16) ounce cans, either through dispensing machines placed about the golf course, or at the club facilities including the pro shop, bar or restaurant. Alternatively, many golfers bring their own beverages to the course and place them in the golf cart with coolers, ice bags or the like.

A problem develops while the golfer is on the course consuming the beverages. There are no commercially available beverage insulators, such as coolers, which allow the beverage to remain at a desired temperature while playing golf, making shots, and moving the cart in cycles. Especially in warm climates, the beverage can become extremely warm in a matter of minutes which results in extreme inconvenience to the golfer as well as waste.

There are no commercially available combination golf club covers and beverage coolers which would automatically accompany the golfer on the course when he has his bags and clubs.

It is therefore highly desirable to provide such a combination golf club cover.

It is also highly desirable to provide a combination golf club cover and beverage insulator which is cost effective yet operationally efficient.

It is also highly desirable to provide a combination golf club cover and beverage insulator which can be adapted for use with any given golf club.

It is also highly desirable to provide a combination golf club cover and beverage insulator which readily interfaces with the golf club itself, simultaneously interfaces with a beverage once the club cover is removed from the club, and comprises an integral, unitary device.

It is finally highly desirable to provide a combination golf club cover and beverage insulator which incorporates all of the above mentioned features and objects.

SUMMARY OF THE INVENTION

What is provided is a combination golf club cover and beverage insulator which comprises a unitary device. The cover means has two sections, a first section which receives the golf club head, and a second section which houses the insulating device that receives the beverage. The insulator is a cylindrical sleeve open at both ends which allows the club to pass through the insulator to the furthermost portion of the golf club cover. Once the cover is removed, a beverage can conveniently be placed within the insulator.

It is therefore an object of the invention to provide a combination golf club cover and beverage insulator which is cost effective yet operationally efficient.

It is also an object of the invention to provide a combination golf club cover and beverage insulator which can be adapted for use with any given golf club.

It is also an object of the invention to provide a combination golf club cover and beverage insulator which readily interfaces with the golf club itself, simultaneously interfaces with a beverage once the club cover is removed from the club, and comprises an integral, unitary device.

It is finally an object of the invention to provide a combination golf club cover and beverage insulator which incorporates all of the above objects.

BRIEF DESCRIPTION OF THE DRAWINGS

The above mentioned and other features of this invention and the manner of attaining them will become more apparent and the invention itself will be best understood by reference to the following description of an embodiment of the invention taken in conjunction with the accompanying drawings, wherein:

FIG. 1 is a front plan view of an embodiment of the instant invention.

FIG. 2 is a front plan view of an embodiment of the invention illustrating the device in a position removed from the golf club and ready to receive a beverage.

FIG. 3 is a cross sectional view of the invention taken along line 3—3 of FIG. 1.

DESCRIPTION OF PREFERRED EMBODIMENT(S)

Figure 4:
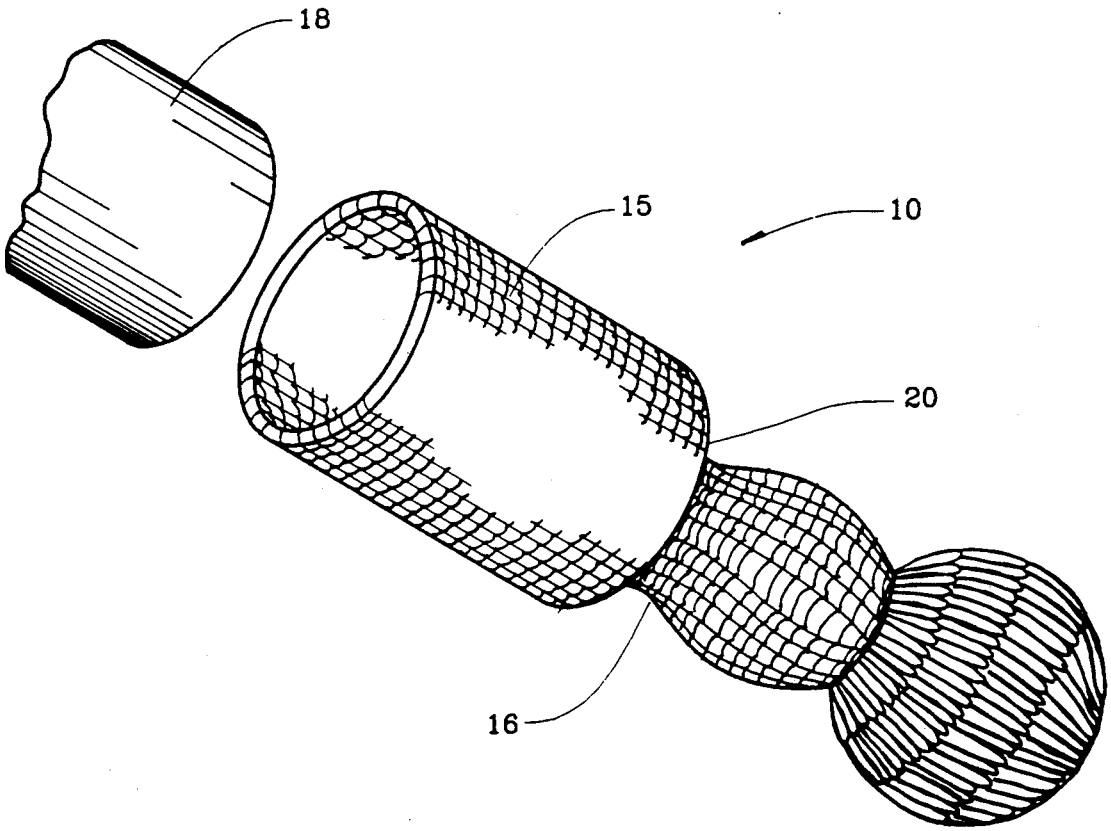
FIG. 4 is a perspective view of an embodiment of the invention illustrating the placement of a beverage within the insulating means.

Referring now to FIG. 1, a combination golf club cover and beverage insulator is shown at 10. The device is generally comprised of a first section 12 and a second section 14. First section 12 is the golf club cover as conventionally used. Second section 14 comprises the insulating means of the invention as further described in detail hereinafter.

Referring particularly to FIG. 3, a cross sectional view of the invention is shown. This view is taken axially along line 3—3 of FIG. 1. In a preferred embodiment, insulator means 15 consists of a thermally insulating, cylindrical sleeve manufactured form either foam rubber, styrofoam or the like. It will be recognized by those of ordinary skill in the art, that a variety of thermal insulators could be incorporated into the instant invention. For example, a multi-layered composite could be utilized and readily placed within the second section 14. Similarly, conventional insulators such as goose down, insulate or similar materials having the desired thermal and/or metallic characteristics would properly function. The essence is to incorporate an insulating device into the golf club cover which will provide a thermal barrier for a beverage that is placed within the insulating section once it has been removed from a golf club.

FIG. 3 illustrates the insulator 15 as being a cylindrical sleeve of styrofoam which is opened at both ends. This allows the golf club to pass through the insulating section and into the cover section 12 when placed about the clubs in the golfer's bag.

The outer material for the combination device could be manufactured form a variety of sources. For example, the cover material could be fabric, plastic, rubber, or a combination of these materials. Similarly, the cover itself could be rigid or semi-rigid, and even manufactured using injection molding techniques if desired. There are many conventional golf club covers that have been developed over the years. These golf club covers could adapt the spirit of the instant invention by including a second segment which houses or supports the beverage insulator. The insulator must allow for the golf club to pass through the internal section and into the golf club cover for usage. Once the combination device is removed from the golf club, it must also facilitate and thermally protect the beverage.

In a particular embodiment, the first and second sections are connected at 16 using an elastic material. This provides two important functions: when the unit is placed about a golf club it secures the cover to the head of the club such that it cannot be inadvertently removed or lost. It must be realized that the instant invention is applicable to all types of golf clubs, i.e. woods and irons. Although particularly suited for the driver, and fairway woods, the device also has application to irons as illustrated in FIG. 1.

The second essential function of the elastic member is provided once the device is removed from the golf club, and receives a beverage. The vast variety of beverages available on a golf course are cans of the twelve and sixteen ounce variety. FIG. 4 illustrates the placement of such a can 18 into the insulator 15. Once the beverage reaches its lowermost portion 20 of the insulator, it is maintained in that position by the contracted elastic member 16.

FIG. 2 illustrates fastening means 22 which provides a convenient way of securing the beverage cooler to a portion of the golf cart during play. For example, the unit can easily be secured to the golf cart frame, bars, rods, or any other section which can receive the hook member 22. In alternative embodiments, fastening members can be incorporated such as Velcro straps, snaps, buttons, etc While there have been described above the principles of this invention in conjunction with specific apparatus, it is to be clearly understood that this description is made only by way of example and not as a limitation to the scope of the invention.

What I claim is:

1. A combination golf club cover and beverage container insulator, comprising:

cover means, said cover means for receiving and protecting the head of a golf club and including as a unitary part thereof an insulating means for receiving said beverage container, said insulating means providing a thermal barrier about the periphery of said beverage container.

2. The apparatus of claim 1, wherein said cover means has a first section, and a second section, said first section receiving said golf club head, said second section housing said insulating means, said first and second sections being generally aligned.

3. The apparatus of claim 2, wherein said cover means is manufactured from a fabric material, said cover means including an elastic portion connecting said first and second sections.

4. The apparatus of claim 2, wherein said insulating means constitutes a cylindrical sleeve, said cylindrical sleeve being opened at its ends, allowing a golf club to pass through said sleeve unencumbered for placement within said cover means.

5. The apparatus of claim 1, wherein said cover means is manufactured from a fabric material.

6. The apparatus of claim 1, wherein said insulating means is a multi-layered composite.

7. The apparatus of claim 1, further comprising fastening means, said fastening means for positioning said combination golf club cover and beverage container insulator to a golf cart section once a beverage container has been placed within said combination cover and insulator.

8. The apparatus of claim 7, wherein said fastening means is a combination hook and pin.

9. The apparatus of claim 7, wherein said fastening means is comprised of Velcro straps.

10. The apparatus of claim 1, wherein said cover means is manufactured from a plastic material.

11. The apparatus of claim 1, wherein said cover means is manufactured from a rubber material.

12. The apparatus of claim 1, wherein said insulating means is manufactured from a foam rubber material.

13. The apparatus of claim 1, wherein said insulating means is manufactured from a styrofoam material.

14. The apparatus of claim 1, wherein said insulating means is manufactured from a down material.

15. A combination golf club cover and beverage container insulator, comprising:

cover means, said cover means for receiving and protecting the head of a golf club;

said cover means having a first section, and a second section, said first section receiving said golf club head, said second section housing an insulating means, said first and second sections being generally aligned; said cover means including an elastic portion connecting said first and second sections;

said insulating means for receiving said beverage container, said insulating means providing a thermal barrier about the periphery of said beverage container; said combination golf club cover and beverage insulator being a unitary device;

wherein said insulating means constitutes a cylindrical sleeve, said cylindrical sleeve being opened at its ends, allowing a golf club to pass through the sleeve unencumbered for placement within said first section; and fastening means, said fastening means for positioning said combination golf club cover and beverage insulator to a golf cart section once a beverage container has been placed within said combination cover and insulator.

* * * * *